United States Patent [19]

Röhser

[11] 4,340,383

[45] Jul. 20, 1982

[54] PROCESS FOR SIMULTANEOUS DYEING AND BONDING OF SEWING SILKS MADE FROM POLYESTER FILAMENTS

[75] Inventor: Helmut Röhser, Hofheim am Taunus, Fed. Rep. of Germany

[73] Assignee: Hoechst Aktiengesellschaft, Frankfurt am Main, Fed. Rep. of Germany

[21] Appl. No.: 236,606

[22] Filed: Feb. 20, 1981

[30] Foreign Application Priority Data

Feb. 22, 1980 [DE] Fed. Rep. of Germany ..... 3006687

[51] Int. Cl.[3] ..... D06P 7/00; D06P 1/54; D06P 1/56

[52] U.S. Cl. ..... 8/494; 8/495; 28/169; 28/217

[58] Field of Search ..... 8/495, 494; 28/217, 28/169

[56] References Cited

U.S. PATENT DOCUMENTS

| | | | |
|---|---|---|---|
| 2,244,761 | 6/1941 | Brandwood | 8/495 |
| 3,232,692 | 2/1966 | Wilhelm et al. | 8/495 |
| 3,891,386 | 6/1975 | Reid et al. | 8/495 |
| 3,893,806 | 7/1975 | Finch et al. | 8/495 |

FOREIGN PATENT DOCUMENTS

| | | |
|---|---|---|
| 2638237 | 6/1981 | Fed. Rep. of Germany . |
| 1556917 | 11/1979 | United Kingdom . |

*Primary Examiner*—Maria Parrish Tungol
*Attorney, Agent, or Firm*—Curtis, Morris & Safford

[57] ABSTRACT

By the use of acrylic resins capable of being cross-linked under the effect of heat, and of disperse dyestuffs in the same padding bath, subsequent drying and thermosol treatment of the padded threads (twist) with subsequent reductive purification and application of a fiber preparation, bonding and simultaneous fast dyeing of sewing silks consisting of polyester multifilaments is achieved, which meets the requirements of the practice with respect to this article. The process is carried out continuously during rewinding.

4 Claims, No Drawings

PROCESS FOR SIMULTANEOUS DYEING AND BONDING OF SEWING SILKS MADE FROM POLYESTER FILAMENTS

The present invention relates to a process for simultaneous dyeing and bonding of sewing silk consisting of filaments of linear polyesters.

Twisted endless filaments (multifilaments) are generally used as sewing silks. The silk processing industry requires for this article, among other things, good running i.e. sliding properties at high sewing speed. However, at the usually high sewing speed which cannot be compared with those of household sewing machines, high mechanical stress by friction and heating occurs at the places of thread guidance, especially at the eye of the needle. Therefore, attention must be paid that the sewing silk is not damaged on sewing, i.e. that the twisted thread is not split into individual filaments.

For this reason, as protection against such harmful influences, sewing silks consisting of polyamide material, for example, have been bonded (sheathed) with a plastic film and simultaneously dyed and acid dyestuffs according to the acid shock method. Sewing silks of polyamide filaments, however, have the disadvantage of softening at a relatively low temperature and subsequently stretching or even melting, which leads to breaking of the thread. From this point of view, sewing silks consisting of polyester filaments are in a very high demand because of their excellent technological properties. Their special advantage, compared with silks of polyamide filaments, is the higher softening or melting point of the polyester material and the lower elongation when sewing on machines. Thus, both factors allow higher sewing speeds.

Up to now, no process has been known for simultaneously bonding and dyeing such polyester filaments for sewing silks. The bonding products and dyestuffs used for this purpose on polyamide material are unfit for polyester material.

From German Offenlegungsschrift No. 2,638,237, however, a process is known, according to which filament bundles, which are intended for the manufacture of technical ribbons or safety belts and which consist of polyester monofilament, are dyed with disperse dyestuffs according to a thermosol process, with the assistance of the effect of an accompanying synthetic resin. The auxiliary cover of the synthetic resin, in this case, has mainly the objective of protecting the disperse dyestuff which is not yet fixed, but already applied to the filaments, especially against abrasion during the weaving of the ribbons. Real fixation of the textiles, together with the dyestuffs applied, is only performed by the thermosol operation after weaving.

In contrast thereto, when bonding sewing silk made from multifilaments, other circumstances, however, must be taken into consideration, which simultaneously outline the objects of the present invention.

The following requirements have to be met:

(a) Sewing silk (of polyester filament) is to be fast-dyed. In the case of polyester material this can only be achieved by disperse dyestuffs. Moreover, the dyeing must be repurified by reduction, in order to remove dyestuff which has been superficially deposited on filaments.

(b) The individual filaments of the sewing silk must have corresponding technological properties, that means, they must have a predetermined shrinkage and elongation behavior. These qualifications can only be provided by a thermofixation process.

(c) The sewing silk must stand the high mechanical stress of sewing and for this end it must have certain characteristics. Above all, splitting of the twisted sewing silk into individual filaments, for example, on tearing of one individual filament in the multifilament, must be prevented. Moreover, the so-called snarling, i.e. the formation of little loops when entagling the threads in the seams, is to be avoided. Electrostatic charge of the filaments is not desirable, either, abrasion is to be reduced and the strength of the thread is not to be diminished. Bonding gives the sewing silk these intended properties.

Thus, it was object of the present invention to dye and simultaneously to bond polyester filaments for use in sewing silks, and to ensure at the same time that the bonding does not adversely affect the properties of the dyeing and, on the other hand, that the requirements for the dyeing do not impair the bonding, either.

This object is achieved in accordance with the invention by continuously padding the twisted multifilament, during the rewinding operation, with an aqueous dispersion containing one or more disperse dyestuffs, a binder system of one or more polymerizable acrylic compounds capable of being thermally cross-linked and a catalyst which promotes cross-linking, at a liquor pick-up of 15 to 25% (of the weight of the dry filament material), subsequently drying the padded threads, subjecting them for 15 to 60 seconds to a heat treatment with hot air of 190°–225° C., repurifying by reduction of the sewing silk so treated before winding it up again and finally applying on to it a usual fiber preparation.

In the practice, the process as claimed is advantageously carried out as follows:

During the rewinding, the sewing silk of polyester filaments is continuously forwarded from a beaming creel or warp beam support over a foulard, in which the padding liquor is applied with, for example, a liquor pick-up of about 20% (of the weight of the dry filament material), to the dryer, preferably a cylinder dryer. From there the threads which were dried at at least 110° C. are passed through the hot air zone, where simultaneously the polyester filament material is fixed and stabilized, the dyeing is fixed and the acrylic resin is set. Via cooling rolls, which are also intended to serve as tension compensators, the sewing silk which now is dyed and bonded is passed to the aftertreatment. The washing machine should have 4 baths, one for the reductive, alkaline aftertreatment, one for rinsing, one for the neutralization and one for the preparation. Next, the substrate is dried again (cylinder drier or hot air zone) and then the dyed and bonded sewing silk is wound up.

In the new process, the amount and composition of the dispersion of the polymerizable acrylic compounds capable of being crosslinked are of special importance. In general, 200–400 g/l of these resin-forming substances are used, preferably a copolymer of ethyl acrylate, N-methylol-acryl-amide and acrylonitrile.

As catalyst which promotes cross-linking and has acidic action only under heat, substances of the type of alkylolamine hydrochlorides, especially aminopropanol hydrochloride, are used in accordance with the invention.

In view of the large amount of cross-linkable acrylic compounds used, it was surprising that the hardening expected as a consequence of the resin formation has not impaired the suppleness of the silk, but has caused the desired bonding effect, that means the bonding of the individual filaments, without reducing the flexibility of the fiber. Moreover, it was not to be expected that this bonding itself is not impaired by the subsequent reductive aftertreatment of the dyed product in intensively alkaline medium at an elevated temperature, which is absolutely necessary for the fastness of the dyeing, and that the desired smoothing and glueing of the individual filaments is maintained.

The technological properties of the finished sewing silk depend substantially on the precise supervision of the drying and fixation conditions. Depending on the titer of the individual filaments and on their number in the silk, the length of time for passing through the heating zone must be adapted to be between 15 to 60 seconds.

Moreover, selection of a suitable fiber preparation is also decisive for achieving good running properties of the silk on sewing. In this respect, plasticizers on the basis of oleylsarcoside, paraffin oil emulsions and products on the basis of silicone oil or mixtures of these products have prooved to be suitable.

The following examples illustrate the invention.

EXAMPLE 1

150 kg of twisted multifilament of dtex 226 f 64×3 of linear polyesters (sewing silk) on bobbins of 2.5 kg each, are creeled on a beaming creel, warped while being unwound and padded on a foulard at room temperature and with 20% liquor pick-up (of the weight of the material) with an aqueous liquor of the following composition:

600 g/l of an aqueous, 40% dispersion of a copolymer of
84% of ethyl acrylate,
11% of N-methylol acrylamide and
5% of acrylonitrile (percentages are given by weight)
30 g/l of aminopropanol hydrochloride (catalyst),
9.7 g/l of the disperse dyestuff 2,6-dicyano-4-nitro-2'-acetylamino-4'-diethylamino-azobenzene,
4.14 g/l of the disperse dyestuff of the formula

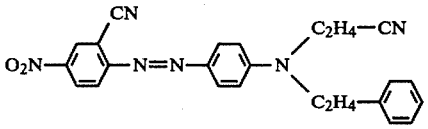

and 10.68 g/l of the disperse dyestuff of the formula

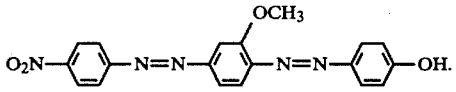

After padding the wet filament material is dried on drying cylinders at about 110° C. and then subjected to hot air treatment at 210° C. for 25 seconds. After cooling, the dyeing thus obtained is continuously repurified on cooling rolls. The temperature of the reductive repurification bath is 85° C.; per 1 kg of polyester filament in 1 liter of water there have to be employed:

24 $cm^3$ of sodium hydroxide solution (32.5%)
24 g of sodium dithionite and
6 g of a detergent on the basis of a nonylphenol oxyethylated with 20 mols of ethylene oxide per mol.

Subsequently, the dyeing is rinsed with hot water at 70° C., neutralized with acetic acid and furnished with a preparation in the last bath. The preparation bath contains in 1 liter of water:

6 g/l of oleylsarcoside and
2 g/l of an emulsifiable mineral oil paraffin preparation.

The coat of this preparation is 20% of the weight of the material. Subsequently, the dyed and bonded polyester filaments are dried and wound up.

A sewing silk dyed black with good running properties on sewing, good strength and sufficient elongation is obtained.

EXAMPLE 2

When using instead of the dyestuffs on Example 1 the following dyestuff combination 4.85 g/l of the disperse dyestuff 2,6-dicyano-4-nitro-2'-acetylamino-4'-diethylaminoazobenzene
2.07 g/l of the disperse dyestuff of the formula

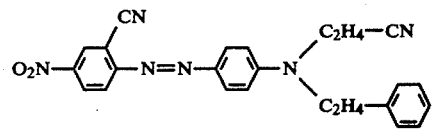

5.34 g/l of the disperse dyestuff of the formula

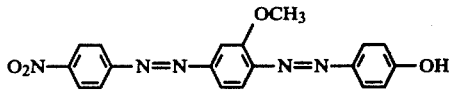

6.75 g/l of the disperse dyestuff of the formula

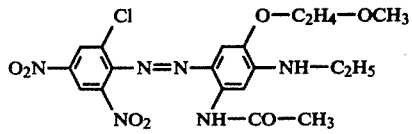

and for the rest carrying out the process as described in Example 1, a dark blue sewing silk with good wear characteristics is obtained.

EXAMPLE 3

The process is carried out exactly as in Example 1, but instead of the dyestuff combination mentioned in Example 1, the following dyestuffs are used:

1 g/l of the dyestuff Disperse Blue 56 C.I. No. 63 285
4 g/l of the disperse dyestuff of the formula

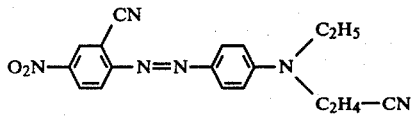

6 g/l of the disperse dyestuff of the formula

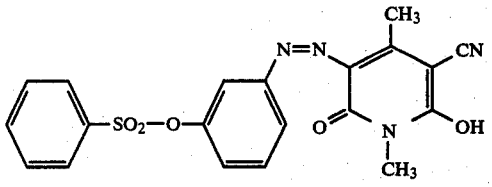

After dyeing, bonding and aftertreatment, a brown sewing silk with the required behavior on sewing is obtained.

The same result as in the Examples 1 to 3 is obtained when using instead of polyester multifilament of dtex 226 f 64, three times twisted, a polyester multifilament of the same titer and the same number of filaments, which, however, is twisted twice.

Corresponding results can also be obtained when using sewing silk of multifilament of dtex 74 f 16 or f 24, twisted two or three times, or of dtex 455 f 96, twisted two or three times, and when subjecting the sewing silk for fixation to a hot air treatment for 15 or 60 seconds.

What is claimed is:

1. A process for the simultaneous dyeing and bonding of sewing silk consisting of filaments of linear polyesters, which comprises continuously padding the twisted multifilament, during a rewinding operation, with an aqueous dispersion which contains one or more disperse dyestuffs, a binder system of one or more thermally cross-linkable, polymeric components selected from the group consisting of homopolymers and copolymers of acrylic acid derivatives and a catalyst which promotes cross-linking, at a liquor pick-up of 15 to 25%, relative to the weight of the dry filament material, subsequently drying and subjecting the padded twisted multifilament to a heat treatment with hot air of from 190° to 225° C. for a time of from 15 to 60 seconds, continuously after-scouring the sewing silk in a hot alkaline bath containing a reducing agent before winding it up again and finally applying onto it a fiber preparation comprising a usual plasticizer.

2. The process according to claim 1, wherein the padding liquor contains 200 to 400 g/l of the cross-linkable polymeric component or components.

3. The process according to claim 1 or 2, wherein the cross-linkable polymeric component is a copolymer of ethyl acrylate, methylol acrylamide and acrylonitrile.

4. The process according to claim 1 or 2, wherein the catalyst promoting cross-linking is an alkylolamine hydrochloride.

* * * * *